US005718622A

United States Patent [19]

Jones

[11] Patent Number: 5,718,622

[45] Date of Patent: Feb. 17, 1998

[54] ABRASIVE HOLDER

[76] Inventor: Jason Robert Jones, 41 Torino St Panmure, Auckland, New Zealand

[21] Appl. No.: 581,998

[22] Filed: Jan. 2, 1996

[30] Foreign Application Priority Data

Jan. 5, 1995 [NZ] New Zealand ..... 270287

[51] Int. Cl.[6] ..... B24D 15/00

[52] U.S. Cl. ..... 451/524; 451/523

[58] Field of Search ..... 451/523, 524, 451/525, 526, 538, 534, 539

[56] References Cited

U.S. PATENT DOCUMENTS

| | | | |
|---|---|---|---|
| 2,485,295 | 10/1949 | Larson | 451/538 |
| 2,729,925 | 1/1956 | Applegate | 451/524 |
| 2,809,476 | 10/1957 | Bourdunis | 451/524 |
| 2,817,931 | 12/1957 | Houser | 451/525 |
| 2,888,785 | 6/1959 | Kellican et al. | 451/538 |
| 3,123,946 | 3/1964 | Hoveland | 451/524 |
| 3,144,737 | 8/1964 | Faas | 451/538 |
| 3,279,130 | 10/1966 | Nelson | 451/524 |
| 3,562,967 | 2/1971 | Eriksen | 451/524 |
| 4,475,317 | 10/1984 | Dicke | 451/523 |
| 4,774,789 | 10/1988 | Amalfi | 451/525 |
| 4,885,876 | 12/1989 | Henke | 451/525 |
| 5,313,746 | 5/1994 | Zarriello | 451/524 |

*Primary Examiner*—James G. Smith
*Assistant Examiner*—Derris H. Banks
*Attorney, Agent, or Firm*—Smith-Hill and Bedell

[57] ABSTRACT

An abrasive holder has a moulded base for a pad of a closed cell foam or cork. The support has a handle for finger and thumb operation. The pad is glued to the base and supports a peel-off piece of abrasive cloth or paper having an adhesive face. The holder is for fine work or working in contact with glass. The pad prevents scratching while permitting surface preparation up to the glass border. Acrylic emulsion adhesives and foam densities of 30–200 kg\m$^3$ are disclosed.

18 Claims, 2 Drawing Sheets

ABRASIVE HOLDER

TECHNICAL FIELD

This invention concerns devices to facilitate sanding especially sanding of difficult surfaces.

BACKGROUND ART

In the finishing stages of cabinet work where solid timber and veneer is used it is customary to use an abrasive paper or cloth wrapped around a cork block to avoid rounding corners and edges. In the preparation stages of painting it is usual to utilise the same type of cork block to smooth the stiles and rails of window frames.

As garnet paper and glass paper contain inclusions which are harder than window glass it is easy to mar the glazing by scratching the glass as the surrounding frame is rubbed. Cork blocks have no arris and therefore cannot reach an internal corner entirely.

This invention addresses the problem.

SUMMARY OF THE INVENTION

This invention provides a sanding aid comprising a holder intended to be gripped by the fingers or in the palm with a base capable of supporting and retaining by adhesive an exchangeable sheet of abrasive paper or cloth.

The base of the holder may be polygonal in plan and flat. Preferably the base is rectangular in order to take rectangular sheets of abrasive medium. The holder may have a handle extending from the base in order to improve the grip. Handles which give a low centre of gravity are preferred. They tilt the paper the least during sanding and give more uniform results. The holder and base may be a unitary moulding of polythene pvc or polypropylene because these have the requisite pliability in all but the coldest working conditions.

The holder may be disposable but is expected to last as long as the conventional sanding block if used with care. Better contact is possible if there is a resilient layer between the holder and the abrasive medium. The layer may be layer of plastic foam of medium density, i.e. having a density in the range of 30–200 kg/m$^3$, preferably 30–70 kg/m$^3$. The layer may be 4–20 mm usually 4–10 mm thick. Neoprene and like synthetic polymers are convenient in that they keep clean and do not scuff.

The resilient layer may have a straight edge. The effect of such layer is to separate the abrasive from the glass when a window frame is being cleaned up. This is because the abrasive does not extend beyond the holder as it does in a conventional sanding block.

The holder may instead be a block of cork or expanded polymer beads or a cut block of rigid plastic foam or a block parted from an extruded rigid polymeric product. The block may be coated to resist deterioration. Paint or transparent resin suffices. The resilience of the beaded block matches that of cork and enables the block to take the abrasive over protruding nail heads and other nibs without ripping.

Whereas the base of the holder may have a single flat for treating planar surfaces, the base may have two flat surfaces mutually at 90°, either convexly arranged for sanding an internal corner or concavely arranged to allow the user to sand an external corner.

The adhesive bond between the resilient pad and the sheet of abrasive paper may depend on a pressure-sensitive type which releases and re-adheres. An acrylic emulsion adhesive has this property. The adhesive may be a coating applied to one of the surfaces but usually it is a sheet impregnated with the adhesive presenting an attachment surface to both pad and paper. Laminated double sided tape is also acceptable. The adhesive layer may be disturbed and reestablished many times in the life of the holder. Suitable adhesives are known in the art.

In another version the base may be a plastic moulding adapted to operate as a pole sander. In still another the handle may be a conventional arcuate handle like a suitcase grip. The invention is useful for fine Work in vehicle bodywork repair and restoration where wet and dry paper is useful and in model building.

BRIEF DESCRIPTION OF THE DRAWINGS

Certain embodiments of the invention are now described with reference to the accompanying drawings in which.

BEST MODE OF CARRYING OUT THE INVENTION

Figure 1:
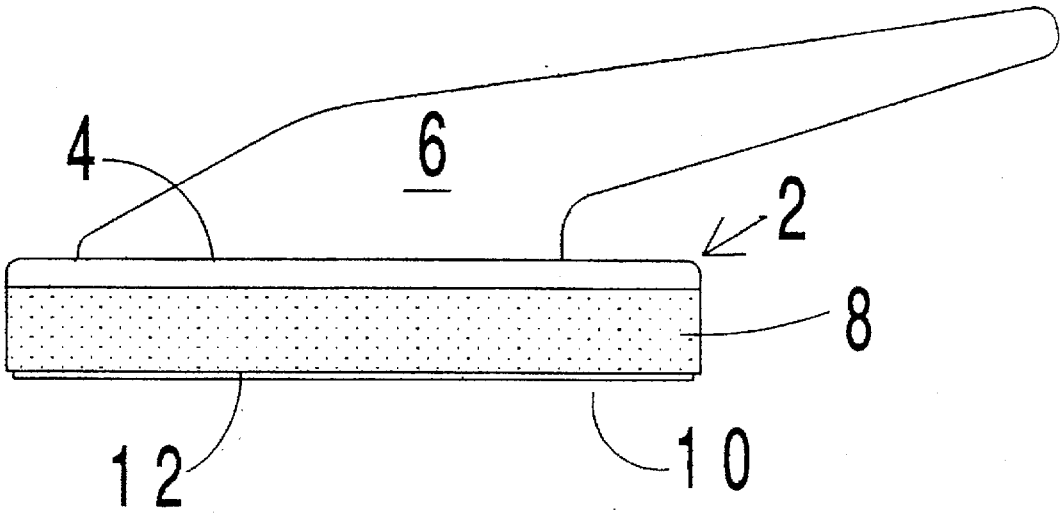
FIG. 1 is a side view of the device.

Holder 2 is a polypropylene moulding with a flat base 4 50×35 mm and a handle 6. Adhered to the flat lower surface of the base is an ethylene vinyl acetate copolymer pad 8, 4 mm thick. This is obtainable as EVA 60. The pad is cut with a clicker die from a sheet. The attachable face of the pad is covered with a tissue sheet saturated with acrylic emulsion adhesive. The sheet adheres to the pad and presents a tacky surface to the lower surface of the base 4 against which the now adhesive pad is pressed.

The paper 10 is coated with acrylic emulsion adhesive. This presents a dry but tacky face to the pad's lower surface 12. The paper can be removed in one piece by peeling. The paper allows no overlap with the pad so that adjacent glass surfaces cannot be scratched unless the paper is carelessly applied. A strong pull peels the paper from pad surface 12 without pulling the pad off the base 4.

Figure 2:
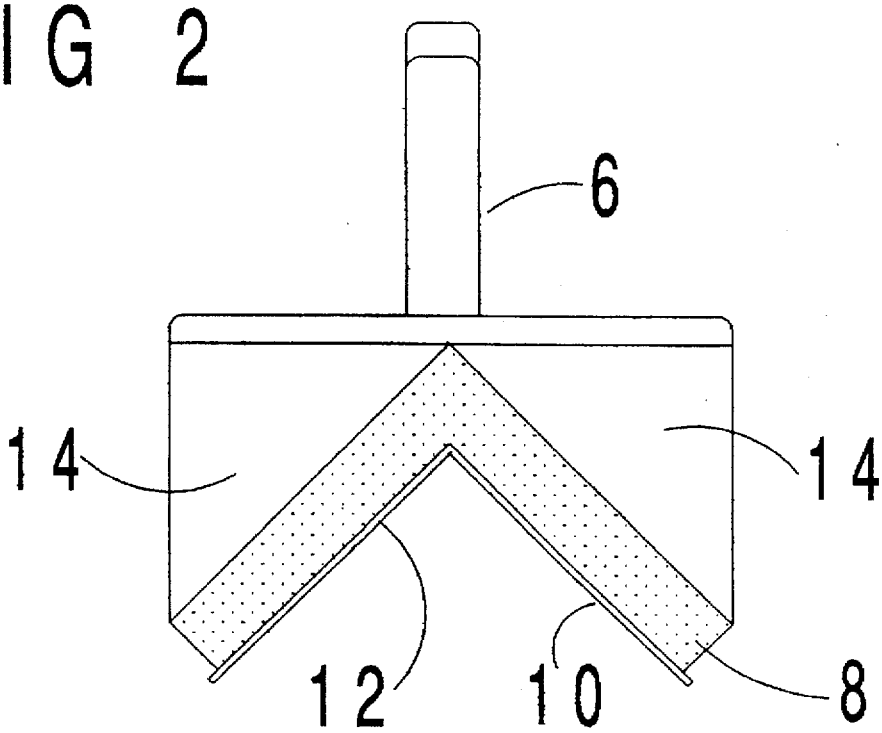
FIG. 2 is an end view of a modified form of the device adapted for external corners.
Figure 3:
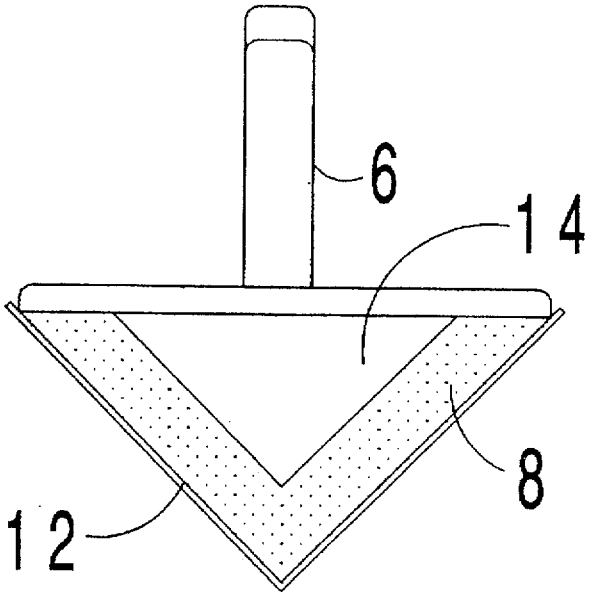
FIG. 3 is an end view of a modified form of the device adapted for internal corners.

In FIG. 2 the face includes a pair of triangular pvc extrusions 14 having respective flat surfaces, concavely arranged at an angle of 90°. The flat surfaces support an L-section EVA pad, This enables external corners such as window boards to be finished, In FIG. 3 having two flat surfaces convexly arranged at an angle of 90° the extrusion 3 is centrally mounted and the L-section pad 8 is fixed to the flat surfaces. In FIGS. 2 and 3 the paper is folded and pressed into contact with the face 12 of pad 8. When worn the paper 10 is pulled off and exchanged.

Figure 4:
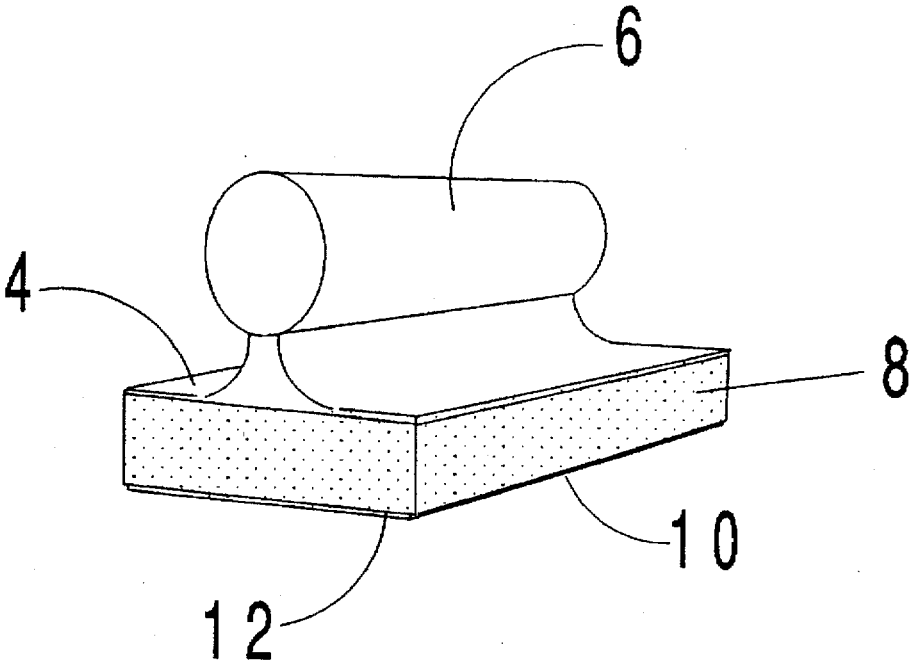
FIG. 4 is a diagram of a hand sander.

In FIG. 4 rigid pvc base 2 has a 100×250 mm EVA pad 8 and integral handle 6. In a non-illustrated version the construction is the same as FIG. 1 except the base is skirting depth and the handle is inclined away from the surface to be sanded in order to protect the knuckles from the floor.

I claim:

1. A sanding aid for releasably supporting an exchangeable sheet of abrasive paper, comprising:

a holder having a base with at least one substantially flat surface, a handle portion for holding in a user's hand, said handle portion being rigidly attached to the base so that the base moves with the handle portion, and a resilient foam pad having a top surface in confronting and mutually attached relationship with the substantially flat surface of the base and also having a lower surface, said pad having a density in the range from about 30 to about 200 kg/m$^3$ and a thickness in the range from about 4 to about 20 mm, and a coating of releasable pressure-sensitive adhesive material on the lower surface of the resilient foam pad for attaching the sheet of abrasive paper to the lower surface of the pad in confronting and mutually releasable relationship.

2. A sanding aid according to claim 1, wherein the resilient pad is made of ethylene vinyl acetate propolymer.

3. A sanding aid according to claim 1, wherein the density of the pad is in the range from about 30 to about 70 kg/m$^3$.

4. A sanding aid according to claim 1, wherein the thickness of the pad is in the range from about 4 to about 10 mm.

5. A sanding aid according to claim 1, wherein the base of the holder has two substantially flat surfaces convexly arranged at 90° and the resilient pad has two portions with respective top surfaces in confronting and mutually attached relationship with the flat surfaces respectively.

6. A sanding aid according to claim 1, wherein the base of the holder has two substantially flat surfaces concavely arranged at 90° and the resilient pad has two portions with respective top surfaces in confronting and mutually attached relationship with the flat surfaces respectively.

7. A sanding aid according to claim 1, wherein the base and the pad each have at least one common working edge and the pad working edge projects laterally beyond the holder working edge in order to contact an adjacent glass surface.

8. A sanding aid according to claim 7, wherein the projection is from about 1 to about 3 mm.

9. A sanding aid according to claim 1, wherein the adhesive material is an acrylic emulsion adhesive material.

10. A sanding aid comprising:

a holder having a base with at least one substantially flat surface and a handle portion for holding in a user's hand, said handle portion being rigidly attached to the base so that the base moves with the handle portion, and a resilient foam pad having a top surface in confronting and mutually attached relationship with the substantially flat surface of the base and also having a lower surface, said pad having a density in the range from about 30 to about 200 kg/m$^3$ and a thickness in the range from about 4 to about 20 mm, a coating of releasable pressure-sensitive adhesive material on the lower surface of the resilient foam pad, and a sheet of abrasive paper attached to the lower surface of the pad in confronting and mutually releasable relationship by the coating.

11. A sanding aid according to claim 10, wherein the resilient pad is made of ethylene vinyl acetate propolymer.

12. A sanding aid according to claim 10, wherein the density of the pad is in the range from about 30 to about 70 kg/m$^3$.

13. A sanding aid according to claim 10, wherein the thickness of the pad is in the range from about 4 to about 10 mm.

14. A sanding aid according to claim 10, wherein the base of the holder has two substantially flat surfaces convexly arranged at 90° and the resilient pad has two portions with respective top surfaces in confronting and mutually attached relationship with the flat surfaces respectively.

15. A sanding aid according to claim 10, wherein the base of the holder has two substantially flat surfaces concavely arranged at 90° and the resilient pad has two portions with respective top surfaces in confronting and mutually attached relationship with the flat surfaces respectively.

16. A sanding aid according to claim 10, wherein the base and the pad each have at least one common working edge and the pad working edge projects laterally beyond the holder working edge in order to contact an adjacent glass surface.

17. A sanding aid according to claim 16, wherein the projection is from about 1 to about 3 mm.

18. A sanding aid according to claim 10, wherein the adhesive material is an acrylic emulsion adhesive material.

* * * * *